US009985355B2

(12) United States Patent
Wu et al.

(10) Patent No.: US 9,985,355 B2
(45) Date of Patent: May 29, 2018

(54) ANTENNA MODULE

(71) Applicant: PEGATRON CORPORATION, Taipei (TW)

(72) Inventors: Chien-Yi Wu, Taipei (TW); Chao-Hsu Wu, Taipei (TW); Shih-Keng Huang, Taipei (TW); Chia-Chi Chang, Taipei (TW)

(73) Assignee: PEGATRON CORPORATION, Taipei (TW)

( * ) Notice: Subject to any disclaimer, the term of this patent is extended or adjusted under 35 U.S.C. 154(b) by 11 days.

(21) Appl. No.: 15/218,088

(22) Filed: Jul. 25, 2016

(65) Prior Publication Data

US 2017/0084997 A1 Mar. 23, 2017

(30) Foreign Application Priority Data

Sep. 22, 2015 (TW) ..... 104131295 A

(51) Int. Cl.

| | |
|---|---|
| ***H01Q 1/38*** | (2006.01) |
| ***H01Q 9/40*** | (2006.01) |
| ***H01Q 1/50*** | (2006.01) |
| ***H01Q 9/42*** | (2006.01) |
| ***H01Q 5/35*** | (2015.01) |
| *H01Q 5/314* | (2015.01) |
| *H01Q 5/10* | (2015.01) |

(52) U.S. Cl.

CPC ..... *H01Q 9/40* (2013.01); *H01Q 1/38* (2013.01); *H01Q 1/50* (2013.01); *H01Q 5/35* (2015.01); *H01Q 9/42* (2013.01); *H01Q 5/10* (2015.01); *H01Q 5/314* (2015.01)

(58) Field of Classification Search

CPC .. H01Q 5/10; H01Q 1/48; H01Q 1/38; H01Q 1/50; H01Q 5/314

USPC ..... 343/700 MS

See application file for complete search history.

(56) References Cited

U.S. PATENT DOCUMENTS 6,624,789 B1 9/2003 Kangasvieri et al.
8,552,913 B2 * 10/2013 Ayatollahi ..... H01Q 1/243 343/702

(Continued)

FOREIGN PATENT DOCUMENTS

EP 2091103 A1 8/2009
EP 2466683 A1 6/2012

(Continued)

*Primary Examiner* — Daniel J Munoz
*Assistant Examiner* — Hai Tran
(74) *Attorney, Agent, or Firm* — CKC & Partners Co., Ltd.

(57) ABSTRACT

An antenna module includes a first ground structure, a first radiation portion and a second radiation portion. The first ground structure includes a first ground portion, a second ground portion and ranged between the first ground portion and the second ground portion. The first radiation portion is configured to generate a first resonant mode accompanied with the first ground structure, including a first feeding terminal configured to send and receive a first antenna signal, and a first grounding terminal coupled to the first ground portion. The second radiation portion is configured to generate a second resonant mode in a manner of coupling with the first radiation portion, including a second feeding terminal configured to send and receive a second antenna signal, and a second grounding terminal coupled to the second ground portion.

9 Claims, 5 Drawing Sheets

(56) References Cited

U.S. PATENT DOCUMENTS

| | | | |
|---|---|---|---|
| 2003/0193437 | A1 | 10/2003 | Kangasvieri et al. |
| 2009/0009401 | A1 | 1/2009 | Suzuki et al. |
| 2010/0238072 | A1 | 9/2010 | Ayatollahi et al. |
| 2012/0274532 | A1 | 11/2012 | Kurashima et al. |

FOREIGN PATENT DOCUMENTS

| | | | |
|---|---|---|---|
| TW | I255588 | B | 5/2006 |
| TW | 200943629 | A | 10/2009 |
| TW | I352456 | B | 11/2011 |

* cited by examiner

ANTENNA MODULE

RELATED APPLICATIONS

This application claims priority to Taiwan Application Serial Number 104131295, filed Sep. 22, 2015, which is herein incorporated by reference.

BACKGROUND

Technical Field

The present disclosure relates to an antenna module, particularly, to a double-fed antenna module.

Description of Related Art

Recently, as well as the development of the wireless communication technology the electronic devices in the market such as smart phones and tables widely apply the wireless communication technology to transmit information.

However, with the increasing requirement of the communication, the antenna architecture with multiple antennas is used in the electronic devices to increase the transmission rate. However, it also increases the difficulty of antenna design, and the transmission quality is reduced due to the disturbance between the antennas.

Therefore, it is an important research topic and a target of major development to solve the disturbance between the antennas in a multi-antenna architecture in the field in recent times.

SUMMARY

An aspect of the present disclosure is an antenna module. The antenna module includes a first ground structure, a first radiation portion and a second radiation portion. The first ground structure includes a first ground portion, a second ground portion and a first slit arranged between the first ground portion and the second ground portion. The first radiation portion includes a first feeding terminal and a first grounding terminal, and is configured to generate a first resonant mode of the antenna module accompanied with the first ground structure, in which the first feeding terminal is configured to send and receive a first antenna signal, and the first grounding terminal is electrically coupled to the first ground portion. The second radiation portion includes a second feeding terminal and a second grounding terminal, and is configured to generate a second resonant mode of the antenna module in a manner of coupling with the first radiation portion, in which the second feeding terminal is configured to send and receive a second antenna signal, and the second grounding terminal is electrically coupled to the second ground portion.

Another aspect of the present disclosure is an antenna module. The antenna module includes a ground structure, an isolating portion, a first radiation portion, and a second radiation portion. The isolating portion is electrically coupled to the ground structure. The first radiation portion is configured to generate a first resonant mode of the antenna module in a manner of coupling with the isolating portion, in which a first slit is arranged between the first radiation portion and the isolating portion to form the first slit. The first radiation portion includes a first feeding terminal and a first grounding terminal, in which the first feeding terminal is configured to send and receive a first antenna signal, and the first grounding terminal is electrically coupled to the ground structure. The second radiation portion is configured to generate a second resonant mode of the antenna module in a manner of coupling with the isolating portion. The second radiation portion includes a second feeding terminal and a second grounding terminal, in which the second feeding terminal is configured to send and receive a second antenna signal, and the second grounding terminal is electrically coupled to the ground structure.

It is to be understood that both the foregoing general description and the following detailed description are by examples, and are intended to provide further explanation of the disclosure as claimed.

BRIEF DESCRIPTION OF THE DRAWINGS

The disclosure can be more fully understood by reading the following detailed description of the embodiments, with reference made to the accompanying drawings as follows.

DETAILED DESCRIPTION

Figure 1:
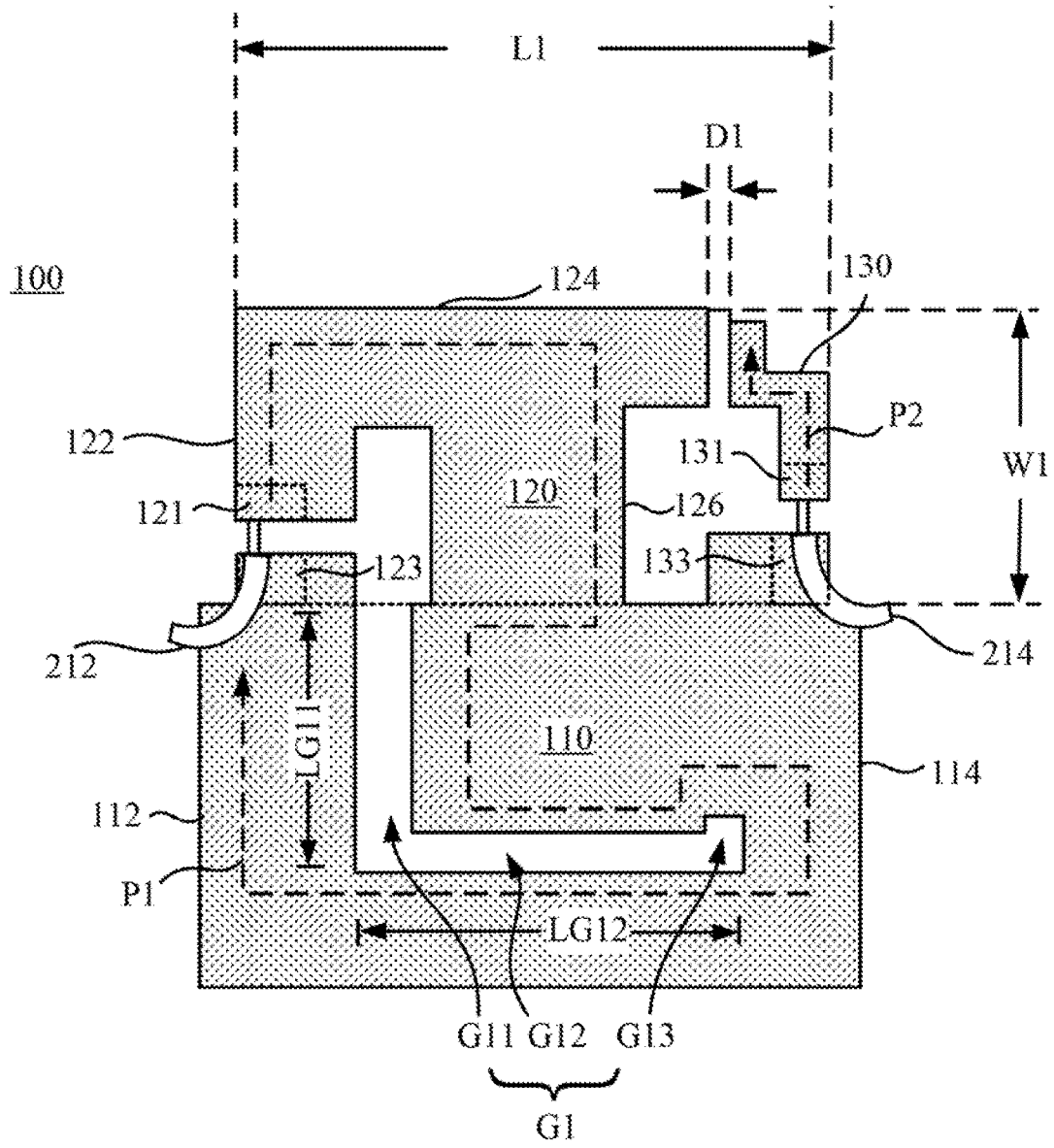
FIG. 1 is a schematic diagram illustrating an antenna module according to some embodiments of the present disclosure.

Reference will now be made in detail to embodiments of the present disclosure, examples of which are described herein and illustrated in the accompanying drawings. While the disclosure will be described in conjunction with embodiments, it will be understood that they are not intended to limit the disclosure to these embodiments. On the contrary, the disclosure is intended to cover alternatives, modifications and equivalents, which may be included within the spirit and scope of the disclosure as defined by the appended claims. It is noted that, in accordance with the standard practice in the industry, the drawings are only used for understanding and are not drawn to scale. Hence, the drawings are not meant to limit the actual embodiments of the present disclosure. In fact, the dimensions of the various features may be arbitrarily increased or reduced for clarity of discussion. Wherever possible, the same reference numbers are used in the drawings and the description to refer to the same or like parts for better understanding.

The terms used in this specification and claims, unless otherwise stated, generally have their ordinary meanings in the art, within the context of the disclosure and in the specific context where each term is used. Certain terms that are used to describe the disclosure are discussed below, or elsewhere in the specification, to provide additional guidance to the practitioner skilled in the art regarding the description of the disclosure.

In addition, in the following description and in the claims, the terms “include” and “comprise” are used in an openended fashion, and thus should be interpreted to mean "include, but not limited to." As used herein, the term "and/or" includes any and all combinations of one or more of the associated listed items.

In this document, the term "coupled" may also be termed "electrically coupled," and the term "connected" may be termed "electrically connected." "Coupled" and "connected" may also be used to indicate that two or more elements cooperate or interact with each other. It will be understood that, although the terms "first," "second," etc., may be used herein to describe various elements, these elements should not be limited by these terms. These terms are used to distinguish one element from another. For example, a first element could be termed a second element, and, similarly, a second element could be termed a first element, without departing from the scope of the embodiments.

Reference is made to FIG. 1. FIG. 1 is a schematic diagram illustrating an antenna module 100 according to some embodiments of the present disclosure. As illustrated in FIG. 1, the antenna module 100 includes a ground structure 110, a radiation portion 120 and a radiation portion 130.

The ground structure 110 includes a ground portion 112, a ground portion 114 and a slit G1. In some embodiments, the slit G1 is arranged between the ground portion 112 and the ground portion 114.

The radiation portion 120 is configured to generate a first resonant mode of the antenna module 100 accompanied with the ground structure 110. In some embodiments, the radiation portion 120 includes a feeding terminal 121 and a grounding terminal 123. The feeding terminal 121 is configured to send and receive a first antenna signal. The grounding terminal 123 is electrically coupled to the ground portion 112. For example, in some embodiments, the feeding terminal 121 and the grounding terminal 123 may be electrically coupled to a positive terminal and a negative terminal of a signal transmission line 212 respectively. Thus, the signal transmission line 212 may transmit the first antenna signal to the feeding terminal 121 via the positive terminal, and is electrically coupled to the ground structure 110 of the antenna module 100 via the negative terminal, such that an electrical path P1 is formed by the radiation portion 120 and the ground structure together.

The radiation portion 130 is configured to generate a second resonant mode of the antenna module 100 in a manner of capacitive coupling with the radiation portion 120. The radiation portion 130 includes a feeding terminal 131 and a grounding terminal 133, in which the feeding terminal 131 is configured to send and receive a second antenna signal, and the grounding terminal 133 is electrically coupled to the ground portion 114. Similarly, in some embodiments, the feeding terminal 131 and the grounding terminal 33 may be electrically coupled to a positive terminal and a negative terminal of a signal transmission line 214 respectively. Thus, the signal transmission line 214 may transmit the second antenna signal to the feeding terminal 131 via the positive terminal, and is electrically coupled to the ground structure 110 of the antenna module 100 via the negative terminal, such that an electrical path P2 is formed in the radiation portion 130.

It is noted that, in some embodiments, the signal transmission line 212 and the signal transmission line 214 may be the coaxial transmission line, but the present disclosure is not limited thereto.

In some embodiments, the antenna module 100 may be asymmetrical double-fed plate antenna module. In addition, in some embodiments, the antenna module 100 may be supported and erected by plastic parts. Alternatively stated, the antenna module 100 may also be a 3D antenna structure and not limited to the plane antenna structure. The plane structure shown in the figure is merely an example for ease of explanation and not meant to limit the present disclosure. The radiation portion 120 forms a loop antenna structure to generate the first resonant mode, and the radiation portion 130 forms a coupling-feed antenna structure to generate the second resonant mode. The length of the electrical path P1 may be correspondingly adjusted by the length and the width of the slit G1, so as to adjust the frequency band of the first resonant mode generated by the radiation portion 120 correspondingly. Similarly, the frequency band of the second resonant mode generated by the radiation portion 130 may also be adjusted by the length of the electrical path P2, such that the first resonant mode and the second resonant mode have the same frequency band or different frequency bands.

In addition, in some embodiments, by properly designing the length and the width of the slit G1 to adjust the electrical path P1, the isolation between the radiation portion 120 and the radiation portion 130 may further be improved, the envelope correlation coefficient (ECC) may be reduced, and the efficiency and gain of the antenna module 100 may be increased.

For example, in the embodiment shown in FIG. 1, the frequency band of the first resonant mode generated by the radiation portion 120 and the frequency band of the second resonant mode generated by the radiation portion 130 is the same, covering the Time Division Duplex-Long Term Evolution (TDD-LTE) B42/B43 band (i.e., 3.4 GHz-3.8 GHz) and Worldwide Interoperability for Microwave Access (WiMAX) band (i.e., 3.3 GHz-3.8 GHz). In the present embodiment, the length L1 of the antenna module 100 is about 20 mm, the width W1 is about 10 mm, and coupling distance D1 between the radiation portion 120 and the radiation portion 130 is about 0.5 mm, the length and the width of the ground structure 110 are about 240 mm and about 110 mm respectively.

In the present embodiment, the radiation portion 120 includes a protrusion part 122, a connecting part 124, and a protrusion part 126. The protrusion part 122 and the protrusion part 126 are extended from the same side of the connecting part 124, in which the protrusion part 122 is electrically coupled to the feeding terminal 121, and the protrusion part 126 is electrically coupled to the ground portion 114 of the ground structure 110.

In the present embodiment, the slit G1 approximately forms a U shape, including a first part G11, a second part G12, and a third part G13. The length LG11 of the first part G11 is about 8 mm, the length LG12 of the second part G12 is about 14 mm. The second part G12 is extended from the first part G11, and is substantially perpendicular to the first part G11. The third part G13 is extended from the second part G12 and substantially perpendicular to the second part G12, and the first part G11 and the third part G13 are extended from the same side of the second part G12.

The route length of the slit G1 is approximately about a quarter of the wavelength of the first resonant mode. Alternatively stated by adjusting the length and the width of the slit G1, the frequency band and the resonant frequency point may be adjusted correspondingly.

The table 1 shown below recites the antenna efficiency and gain in the frequency band, and the EEC and the isolation between the radiation portion 120 and radiation portion 130 of the antenna module 100 shown in FIG. 1.

TABLE 1 efficiency, gain, ECC, and isolation of the antenna

| | First resonant mode | | Second resonant mode | | | |
|---|---|---|---|---|---|---|
| Frequency (MHz) | Efficiency (%) | Gain (dB) | Efficiency (%) | Gain (dB) | ECC | isolation (dB) |
| 3200 | 78.92 | −1.03 | 58.91 | −2.30 | 0.005 | −18.01 |
| 3300 | 84.52 | −0.73 | 65.11 | −1.86 | 0.002 | −18.75 |
| 3400 | 89.62 | −0.48 | 77.52 | −1.11 | 0.003 | −20.17 |
| 3500 | 91.33 | −0.39 | 77.62 | −1.10 | 0.002 | −22.46 |
| 3600 | 90.46 | −0.44 | 73.02 | −1.37 | 0.001 | −24.42 |
| 3700 | 90.25 | −0.45 | 75.20 | −1.24 | 0.001 | −28.20 |
| 3800 | 89.42 | −0.49 | 60.80 | −2.16 | 0.001 | −29.53 |
| 3900 | 91.66 | −0.88 | 70.79 | −1.5 | 0.000 | −24.10 |

As shown in the Table 1, in the present embodiment, the efficiency of the antenna for the first resonant mode and the second resonant mode are both above 55%, and the gain of the antenna are both above about −2.3 db. The ECC are reduced to lower than about 0.1, and the isolation is improved to between about −18 db and about −29 db.

Figure 2A:
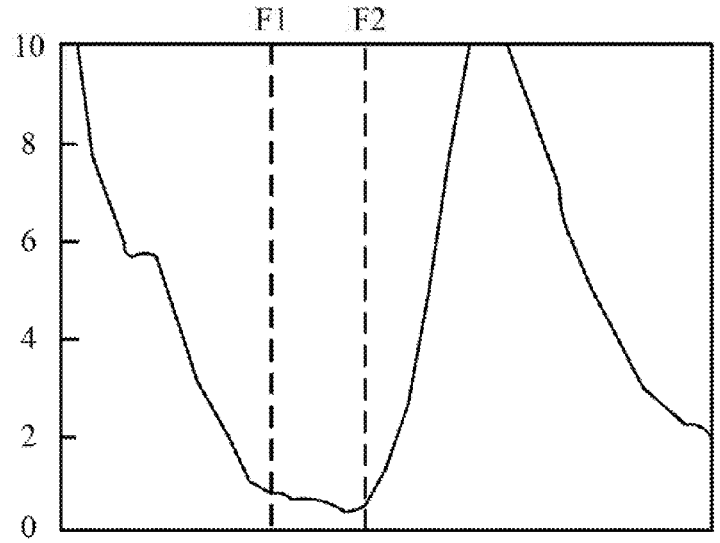
FIG. 2A and the FIG. 2B are diagrams illustrating the characteristics of the voltage standing wave ratio (VSWR) to the frequency of the first resonant mode and the second resonant mode in the antenna module illustrated in FIG. 1 respectively.
Figure 2B:
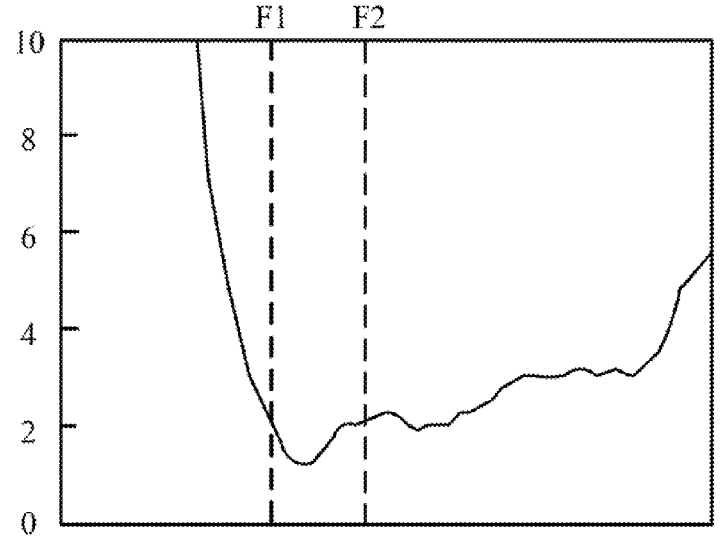
FIG. 2C is a diagram illustrating the characteristics of the isolation between the first resonant mode and the second resonant mode to the frequency in the antenna module illustrated in FIG. 1.

Reference is made to FIG. 2A and FIG. 2B. FIG. 2A and the FIG. 2B are diagrams illustrating the characteristics of the voltage standing wave ratio (VSWR) to the frequency of the first resonant mode and the second resonant mode in the antenna module 100 illustrated in FIG. 1 respectively. In FIGS. 2A and 2B, the x-axis indicates frequency, and the y-axis indicates the voltage standing wave ratio (VSWR), and the frequency F1 is about 3.3 GHz, and the frequency F2 is about 3.8 GHz. As shown in the figure, between the frequency band 3.3 GHz-3.8 GHz, the antenna module 100 in the present embodiment has a relatively low voltage standing wave ratio (VSWR), and thus has relatively high transmission efficiency.

Figure 2C:
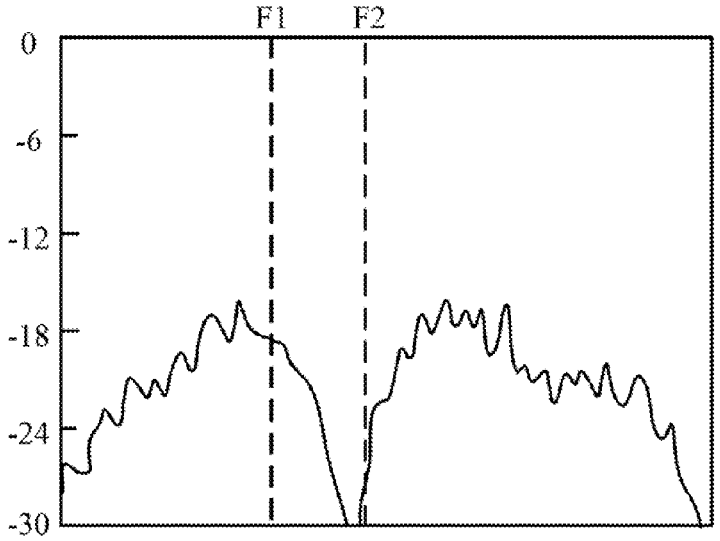

Reference is made to FIG. 2C. FIG. 2C is a diagram illustrating the characteristics of the isolation between the first resonant mode and the second resonant mode to the frequency in the antenna module 100 illustrated in FIG. 1. In FIG. 2C, the x-axis indicates the frequency, and the y-axis indicates the isolation, and the frequency F1 is about 3.3 GHz, and the frequency F2 is about 3.8 GHz. In the present embodiment, since the distributions of the radiation pattern of the first resonant mode and the second resonant mode are centralized in opposite directions on the x-axis (i.e., the direction of the length L1 in FIG. 1), the impact on each other is relatively small.

Alternatively stated, by properly arranging the slit G1, the disturbance between two antennas in the asymmetrical double-fed plate antenna module may be reduced, and further save the space required to locate extra isolation elements. Thus, the size of the antenna module 100 is reduced as well as the isolation of the antenna is improved.

Figure 3:
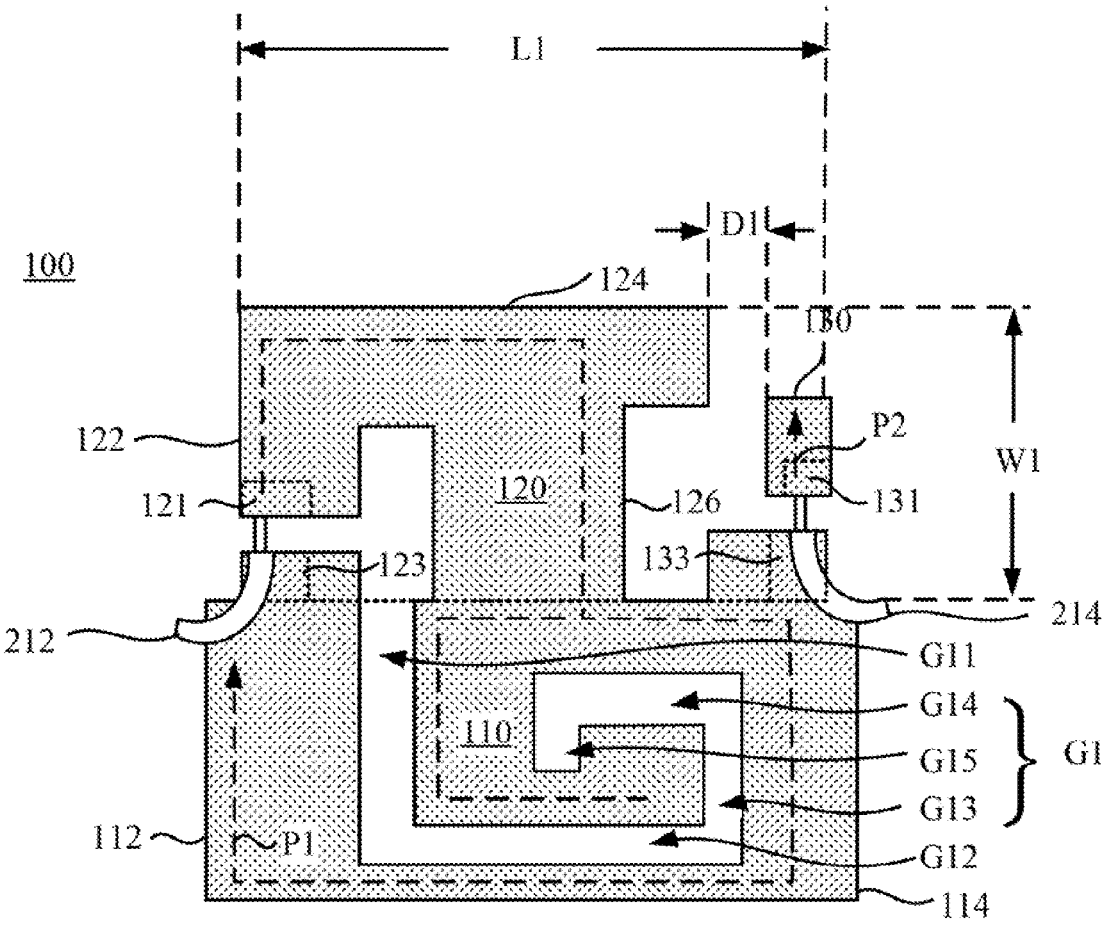
FIG. 3 is a schematic diagram illustrating the antenna module according to some embodiments of the present disclosure.

Reference is made to FIG. 3. FIG. 3 is a schematic diagram illustrating the antenna module 100 according to some embodiments of the present disclosure. Compared to the embodiment shown in FIG. 1, for the antenna module shown in FIG. 3, the frequency band of the first resonant mode is different from the frequency band of the second resonant mode.

The frequency band of the first resonant mode generated by the radiation portion 120 covers the band of the Wi-Fi 2.4 GHz. On the other hand, the frequency band of the second resonant mode generated by the radiation portion 130 covers the band of the Wi-Fi 5 GHz. In the present embodiment, the coupling distance D1 between the radiation portion 120 and the radiation portion 130 is about 0.8 mm.

In the present embodiment, the slit G1 further includes a fourth part G14 and a fifth part G15. The fourth part G14 is extend from the third part G13, and substantially perpendicular to the third part G13, and the second part G12 and the fourth part G14 are extended from the same side of the third part G13. The fifth part G15 is extended from the fourth part G14, and substantially perpendicular to the fourth part G14, and the third part G13 and the fifth part G15 are extended from the same side of the fourth part G14.

Therefore, by further arranging the four part G14 and the fifth part G15, the length of the electrical path P1 may further increased such that the frequency band of the first resonant mode generated by the radiation portion 120 reduced to the band of the Wi-Fi 2.4 GHz. On the other hand, by reducing the length of the electrical path P2, the frequency band of the second resonant mode generated by the radiation portion 130 may be adjusted to the band of the Wi-Fi 5 GHz.

Alternatively stated, by properly arranging the slit G1, the radiation portion 120 may generate the first resonant mode having a relatively low band frequency, and the radiation portion 130 may generate the second resonant mode having a relatively high band frequency.

The table 2 shown below recites the antenna efficiency and gain in the low frequency band and the high frequency band, and the EEC and the isolation between the radiation portion 120 and radiation portion 130 of the antenna module 100 shown in FIG. 3.

TABLE 2 efficiency, gain, ECC, and isolation of the antenna

| | First resonant mode | | Second resonant mode | | | |
|---|---|---|---|---|---|---|
| Frequency (MHz) | Efficiency (%) | Gain (dB) | Efficiency (%) | Gain (dB) | ECC | isolation (dB) |
| 2350 | 61.61 | −2.10 | | | | −27.00 |
| 2400 | 66.25 | −1.79 | | | | −26.30 |
| 2442 | 66.52 | −1.77 | | | | −26.90 |
| 2484 | 68.99 | −1.61 | | | | −27.10 |
| 2550 | 63.44 | −1.98 | | | | −26.30 |
| 5100 | 75.66 | −1.21 | 99.00 | −0.04 | 0.004 | −31.30 |
| 5150 | 65.00 | −1.87 | 87.97 | −0.56 | 0.001 | −34.00 |
| 5250 | 71.54 | −1.45 | 91.31 | −0.39 | 0.001 | −36.00 |
| 5350 | 73.95 | −1.31 | 84.16 | −0.75 | 0.000 | −34.50 |
| 5470 | 76.19 | −1.18 | 87.97 | −0.56 | 0.003 | −31.50 |
| 5725 | 73.46 | −1.34 | 85.04 | −0.70 | 0.002 | −30.80 |
| 5785 | 68.31 | −1.66 | 84.01 | −0.76 | 0.002 | −90.10 |
| 5875 | 67.96 | −1.68 | 82.07 | −0.86 | 0.001 | −29.00 |
| 5950 | 72.33 | −1.41 | 92.08 | −0.36 | 0.003 | −25.40 |

As shown in the Table 2, in the present embodiment, the efficiency of the antenna in the low frequency band and the high frequency band are both above 60% and the gain of the antenna are both above about −2.1 db. The isolation is between about −25 db and about −36 db. In the high frequency band, the ECC between the first resonant mode and the second resonant mode are all lower than about 0.1.

Alternatively stated, the arrangement of the slit G1 may not only applied in the same frequency double-fed antenna, but also applied in double-fed antenna with different frequencies to reduce the disturbance between the antennas. Therefore, the antenna module 100 in the present embodiment may be applied in the antenna applications receiving low frequency band and high frequency band at the same time such as Access Point (AP).

Figure 4:
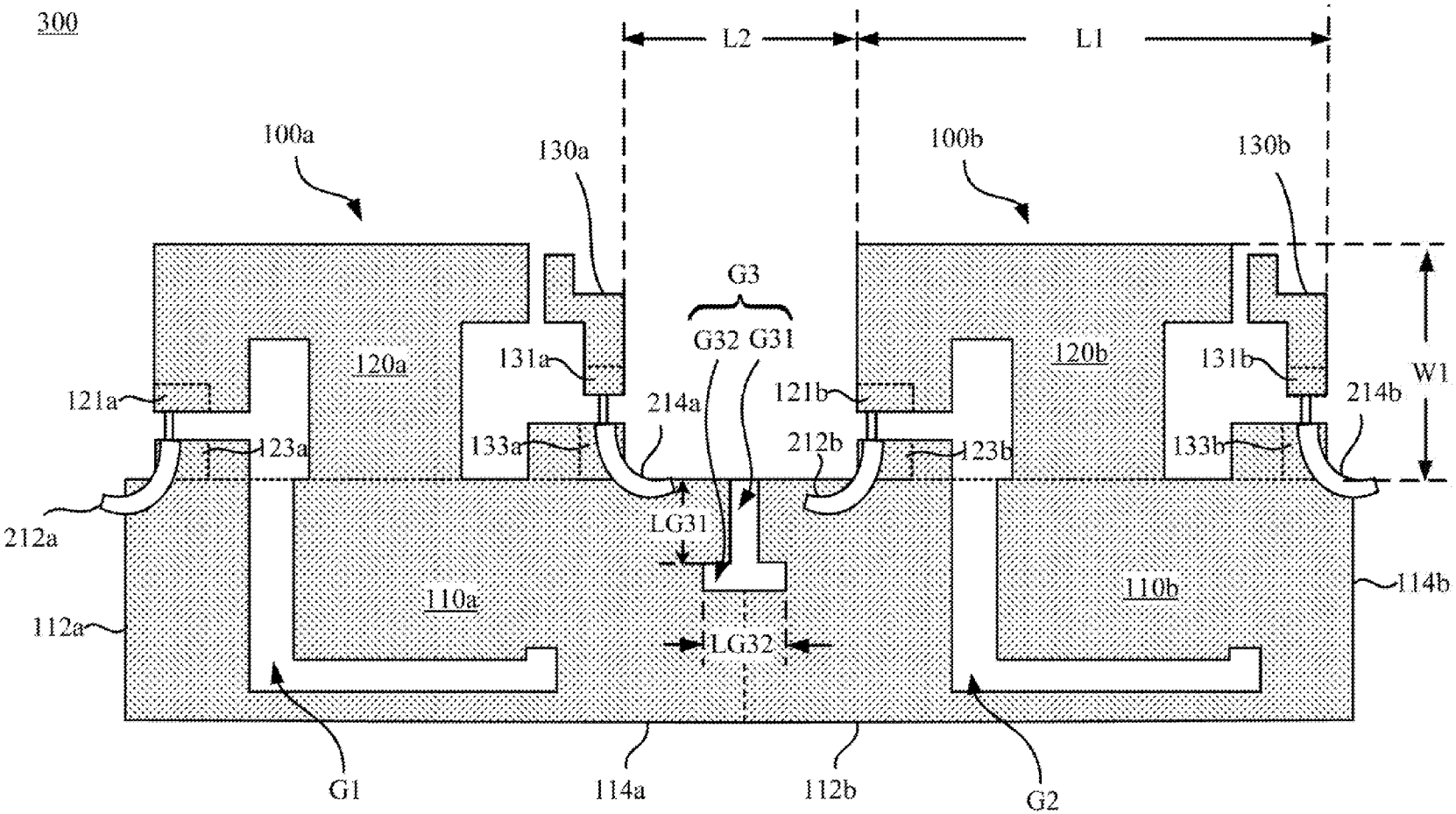
FIG. 4 is a schematic diagram illustrating the antenna module according to some embodiments of the present disclosure.

Reference is made to FIG. 4. FIG. 4 is a schematic diagram illustrating the antenna module 300 according to some embodiments of the present disclosure. In the present embodiment, the antenna module 300 integrates two sets of the antenna modules 100*a* and 100*b* illustrated in the FIG. 1 in a multi-input multi-output MIMO antenna architecture.

In the present embodiment, the antenna module 100*a* includes the ground structure 110*a*, the radiation portion 120*a* and the radiation portion 130*a*. The ground structure 110*a* includes the ground portion 112*a*, the ground portion 114*a*, and the slit G1. The radiation portion 120*a* includes the feeding terminal 121*a* and the grounding terminal 123*a*, and the radiation portion 130*a* includes the feeding terminal 131*a* and the grounding terminal 133*a*. The structure and the operation of the antenna module 100*a* are similar to the antenna module 100 illustrated in the FIG. 1 and thus are omitted herein for the sake of brevity. Compared to the embodiment shown in FIG. 1, in the present embodiment, the antenna module 300 further includes the antenna module 100*b*. In some embodiments, the structure and the operation of the antenna module 100*b* are similar to the antenna module 100*a*. Specifically, the antenna module 100*b* includes the ground structure 110*b*, the radiation portion 120*b* and the radiation portion 130*b*. The ground structure 110*b* is electrically coupled to the ground structure 100*a*, and includes the ground portion 112*b*, the ground portion 114*b*, and the slit G2. The slit G2 approximately forms a U shape, and is arranged between the ground portion 112*b* and the ground portion 114*b*.

The radiation portion 120*b* is configured to generate a third resonant mode of the antenna module 300 accompanied with the ground structure 110*b*. The radiation portion 120*b* includes a feeding terminal 121*b* and a grounding terminal 123*b*, in which the feeding terminal 121*b* is configured to send and receive a third antenna signal, and the grounding terminal 123*b* is electrically coupled to the ground portion 112*b*. The radiation portion 130*b* is configured to generate a fourth resonant mode of the antenna module 300 in a manner of capacitive coupling with the radiation portion 120*b*. The radiation portion 130*b* includes a feeding terminal 131*b* and a grounding terminal 133*b*, in which the feeding terminal 131*b* is configured to send and receive a fourth antenna signal, and the grounding terminal 133*b* is electrically coupled to the ground portion 114*b*.

In the present embodiment, the antenna module further includes a slit G3, in which the slit G3 has a substantially T-shape. The slit G3 includes a first part G31, and a second part G32 which is extended from a terminal of the first part G31, and substantially perpendicular to the first part G31. The slit G3 is arranged between the ground structure 110*a* and the ground structure 110*b*. Specifically, the slit G3 is arranged between the ground portion 114*a* and the ground portion 112*b*.

In an embodiment of the present disclosure, the gap length L2 between the antenna modules 100*a* and 100*b* is about 30 mm. Alternatively stated, the gap between the radiation portion 130*a* and the radiation portion 120*b* is about 30 mm. The route of the slit G3 arranged between them is about a quarter of the wavelength, and configured to improve the isolation between the radiation portion 130*a* and the radiation portion 120*b*. For example, in one embodiment, the length LG31 of the first part G31 of the slit G3 is about 9 mm, and the length LG32 of the second part G32 of the slit G3 is about 7.5 mm. In the present embodiment, the length and the width of the ground surface formed by the ground structures 110*a* and 110*b* are about 154 mm and about 74 mm respectively.

Therefore, the antenna module 300 may send and receive antenna signals respectively via the signal transmission line 212*a*, 214*a*, 212*b*, and 214*b* and be applied in the multi-input multi-output (MIMO) antenna architecture to improve the isolation between multiple antennas. For example, the antenna module 300 may be applied in the fifth generation (5G) mobile communication system applying massive MIMI, so as to increase the antenna efficiency of the mobile devices such as smartphones and tablets.

Figure 5:
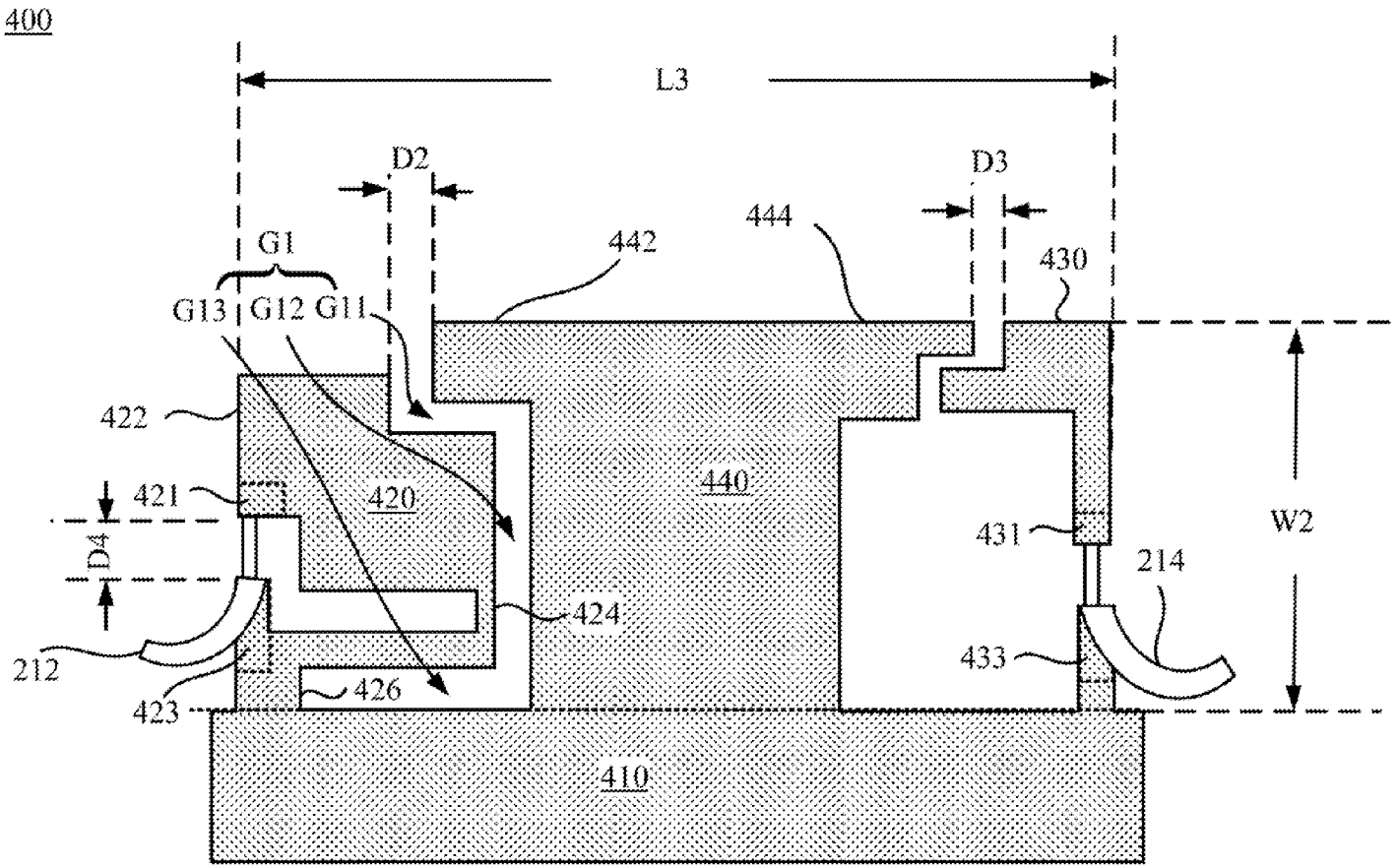
FIG. 5 is a schematic diagram illustrating the antenna module according to some embodiments of the present disclosure.

Reference is made to FIG. 5. FIG. 5 is a schematic diagram illustrating the antenna module 400 according to some embodiments of the present disclosure. As illustrated in FIG. 5, the antenna module 400 includes the ground structure 410, the radiation portion 420, the radiation portion 430, the isolating portion 440 and the slit G1, in which the isolating portion 440 is electrically coupled to the ground structure 410. In one embodiment of the present disclosure, the length L3 of the antenna module 400 is about 25 mm, and the width W2 is about 7 mm.

The radiation portion 420 includes a feeding terminal 421 and a grounding terminal 423, in which the feeding terminal 421 is configured to send and receive the first antenna signal, and the grounding terminal 423 is electrically coupled to the ground structure 410. The radiation portion 420 is configured to generate the first resonant mode of the antenna module 400 in a manner of capacitive coupling with the isolating portion 440

Similarly, the radiation portion 430 includes a feeding terminal 431 and a grounding terminal 433, in which the feeding terminal 431 is configured to send and receive the second antenna signal, and the grounding terminal 433 is electrically coupled to the ground structure 410. The radiation portion 430 is configured to generate the second resonant mode of the antenna module 400 in a manner of capacitive coupling with the isolating portion 440

In the embodiment illustrated in FIG. 5, the isolating portion 440 includes a protrusion part 442, and a protrusion part 444, such that the radiation portion 420 is configured to couple with the protrusion portion 442 to generate the first resonant mode, and the radiation portion 430 is configured to couple with the protrusion portion 444 to generate the second resonant mode. The slit G1 is arranged between the radiation portion 420 and the protrusion portion 442 of the isolating portion 440.

Specifically, the slit G1 in the present embodiment is similar to the slit G1 in the above embodiments, and includes the first part G11, the second part G12, and the third part G13. The second part G12 is extended from the first part G11, and is substantially perpendicular to the first part G11. The third part G3 is extended from the second part G12, and is substantially perpendicular to the second part G12, and the first part G11 and the third part G13 are extended from the same side of the second part G12.

In the present embodiment, the radiation portion 420 includes the protrusion part 422, the connecting part 424 and the protrusion part 426. The protrusion part 422 is electrically coupled to the feeding terminal 421, and the protrusion part 426 is electrically coupled to the grounding terminal 423, in which the protrusion part 422 and the protrusion part 426 are extended from the same side of the connecting part 424. In the present embodiment, the structure and the operation of the radiation portions 420 and 430 are similar to the radiation portions 120 and 130 illustrated in FIG. 1 and thus further explanation are omitted herein for the sake of brevity.

Similar to the embodiments mentioned above, the first resonant mode generated by the radiation portion 420 and the second resonant mode generated by the radiation portion 430 may be configured to have the same frequency band or different frequency bands according to practical needs. For example, in some embodiments, the first resonant mode and the second resonant mode may cover the TDD-LTE B42/B43 frequency band and the WiMAX frequency band. In the present embodiment, the antenna module 400 may configure the frequency band of the first resonant mode to 3.3 GHz-3.8 GHz by adjusting the coupling distance D2 between the radiation portion 420 and the isolation portion 440. Similarly, the antenna module 400 may configure the frequency band of the second resonant mode to 3.3 GHz-3.8 GHz by adjusting the coupling distance D3 between the radiation portion 430 and the isolation portion 440. In addition, the antenna module 400 may also configure resonant frequency point of the first resonant mode by adjusting the length of the protrusion part 442, and the coupling distance D4 between the protrusion part 422 and the protrusion part 426.

Further, in some embodiments, the first resonant mode and the second resonant mode may also be configured to have different frequency bands. For example, the frequency band of the first resonant mode may be configured to the Wi-Fi 2.4 GHz frequency band, and the frequency band of the second sonant mode may be configured to the Wi-Fi 5 GHz frequency band. In the present embodiment, the length L3 of the antenna module 400 is about 30 mm, and the width W1 is about 7 mm.

In the present disclosure, by applying the embodiments mentioned above, the size of the antenna module is reduced, as well as the isolation between antennas is improved and the efficiency of the antenna is increased by arranging slit in the antenna module to adjust the electrical path and radiation pattern. It is noted that, the sizes of the elements or parts disclosed in various embodiments of the present disclosure are merely examples for the ease of the explanation. Alternatively stated, the sizes are possible embodiments of the present disclosure but not meant to limit the present disclosure. One skilled in the art may adjust the sizes based on practical needs.

Although the disclosure has been described in considerable detail with reference to certain embodiments thereof, it will be understood that the embodiments are not intended to limit the disclosure. It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. An antenna module, comprising:

a first ground structure, comprising a first ground portion, a second ground portion and a first slit arranged between the first ground portion and the second ground portion, wherein the first slit comprises a first part, a second part, a third part, a fourth part and a fifth part, and the second part is substantially perpendicular to the first part, and the third part is substantially perpendicular to the second part, and the fourth part is substantially perpendicular to the third part, wherein the first part and the third part are extended from the same side of the second part, the second part and the fourth part are extended from the same side of the third part, and the fifth part is substantially perpendicular to the fourth part, and the third part and the fifth part are extended from the same side of the fourth part;

a first radiation portion, configured to generate a first resonant mode of the antenna module accompanied with the first ground structure, wherein the first radiation portion comprises:

a first feeding terminal, configured to send and receive a first antenna signal; and a first grounding terminal, electrically coupled to the first ground portion; and a second radiation portion, configured to generate a second resonant mode of the antenna module in a manner of coupling with the first radiation portion, wherein the second radiation portion comprises:

a second feeding terminal, configured to send and receive a second antenna signal; and a second grounding terminal, electrically coupled to the second ground portion.

2. The antenna module of claim 1, wherein the first radiation portion further comprises:

a connecting part;

a first protrusion part, electrically coupled to the first feeding terminal; and a second protrusion part, electrically coupled to the second ground portion;

wherein the first protrusion part and the second protrusion part are extended from the same side of the connecting part.

3. The antenna module of claim 1, wherein the frequency band of the first resonant mode is different from the frequency band of the second resonant mode.

4. The antenna module of claim 1, further comprising:

a second ground structure, electrically coupled to the first ground structure, wherein the second ground structure comprises a third ground portion, a fourth ground portion and a second slit arranged between the third ground portion and the fourth ground portion; and a third slit, having a substantially T-shape and arranged between the first ground structure and the second ground structure.

5. The antenna module of claim 4, further comprising:

a third radiation portion, configured to generate a third resonant mode of the antenna module accompanied with the second ground structure, wherein the third radiation portion comprises:

a third feeding terminal, configured to send and receive a third antenna signal; and a third grounding terminal, electrically coupled to the third ground portion; and a fourth radiation portion, configured to generate a fourth resonant mode of the antenna module in a manner of coupling with the third radiation portion, wherein the fourth radiation portion comprises:

a fourth feeding terminal, configured to send and receive a fourth antenna signal; and a fourth grounding terminal, electrically coupled to the fourth ground portion;

wherein the third slit is arranged between the second ground portion and the third ground portion.

6. An antenna module, comprising:

a first ground structure, comprising a first ground portion, a second ground portion and a first slit arranged between the first ground portion and the second ground portion;

a first radiation portion, configured to generate a first resonant mode of the antenna module accompanied with the first ground structure, wherein the first radiation portion comprises:

a first feeding terminal, configured to send and receive a first antenna signal; and a first grounding terminal, electrically coupled to the first ground portion;

a second radiation portion, configured to generate a second resonant mode of the antenna module in a manner of coupling with the first radiation portion, wherein the second radiation portion comprises:

a second feeding terminal, configured to send and receive a second antenna signal; and a second grounding terminal, electrically coupled to the second ground portion;

a second ground structure, electrically coupled to the first ground structure, wherein the second ground structure comprises a third ground portion, a fourth ground portion and a second slit arranged between the third ground portion and the fourth ground portion; and a third slit, having a substantially T-shape and arranged between the first ground structure and the second ground structure a third radiation portion, configured to generate a third resonant mode of the antenna module accompanied with the second ground structure, wherein the third radiation portion comprises:

a third feeding terminal, configured to send and receive a third antenna signal; and a third grounding terminal, electrically coupled to the third ground portion; and a fourth radiation portion, configured to generate a fourth resonant mode of the antenna module in a manner of coupling with the third radiation portion, wherein the fourth radiation portion comprises:

a fourth feeding terminal, configured to send and receive a fourth antenna signal; and a fourth grounding terminal, electrically coupled to the fourth ground portion;

wherein the third slit is arranged between the second ground portion and the third ground portion.

7. The antenna module of claim 6, wherein the first radiation portion further comprises:

a connecting part;

a first protrusion part, electrically coupled to the first feeding terminal; and a second protrusion part, electrically coupled to the second ground portion;

wherein the first protrusion part and the second protrusion part are extended from the same side of the connecting part.

8. The antenna module of claim 6, wherein the first slit comprises a first part, a second part, and a third part, and the second part is substantially perpendicular to the first part, and the third part is substantially perpendicular to the second part, wherein the first part and the third part are extended from the same side of the second part.

9. The antenna module of claim 6, wherein the frequency band of the first resonant mode is different from the frequency band of the second resonant mode.

* * * * *